US007836860B2

(12) United States Patent
Edgar

(10) Patent No.: US 7,836,860 B2
(45) Date of Patent: Nov. 23, 2010

(54) ENGINE ROCKER ARM

(75) Inventor: James R. Edgar, Shorewood, WI (US)

(73) Assignee: Charter Manufacturing Co., Inc., Mequon, WI (US)

( * ) Notice: Subject to any disclaimer, the term of this patent is extended or adjusted under 35 U.S.C. 154(b) by 448 days.

(21) Appl. No.: 11/943,989

(22) Filed: Nov. 21, 2007

(65) Prior Publication Data

US 2009/0126665 A1 May 21, 2009

(51) Int. Cl.
*F01L 1/18* (2006.01)

(52) U.S. Cl. ..... 123/90.39; 29/888.2; 74/559

(58) Field of Classification Search ..... 123/90.39, 123/90.2, 90.25, 90.44; 29/888.2; 74/559, 74/567, 569
See application file for complete search history.

(56) References Cited

U.S. PATENT DOCUMENTS

| | | | | |
|---|---|---|---|---|
| 2,338,726 | A | 1/1944 | Leake | |
| 3,219,019 | A | 11/1965 | Palmer | |
| 4,628,874 | A | 12/1986 | Barlow | |
| 4,697,473 | A | 10/1987 | Patel | |
| 4,825,717 | A | 5/1989 | Mills | |
| 4,829,647 | A | 5/1989 | Anderson et al. | |
| 4,940,048 | A | 7/1990 | Mills | |
| 4,979,475 | A | 12/1990 | Mills | |
| 5,016,582 | A | 5/1991 | Mills | |
| 5,048,475 | A | 9/1991 | Mills | |
| 5,060,606 | A | 10/1991 | Hubbard | |
| 5,207,191 | A | 5/1993 | Pryba et al. | |
| 5,251,585 | A | 10/1993 | Graber | |
| 5,598,815 | A | 2/1997 | Hertrich | |
| 6,415,754 | B1 | 7/2002 | Hirano et al. | |
| 6,523,514 | B1 * | 2/2003 | Motohashi | 123/90.39 |
| 6,615,635 | B2 | 9/2003 | Ammon | |
| 6,729,285 | B2 * | 5/2004 | Ammon et al. | 123/90.39 |
| 7,185,618 | B1 | 3/2007 | Edelmayer | |
| 2005/0229885 | A1 | 10/2005 | Kick-Rodenbucher et al. | |

FOREIGN PATENT DOCUMENTS

| | | | |
|---|---|---|---|
| AT | 004297 | U1 | 5/2001 |
| DE | 19618417 | A1 | 11/1997 |
| DE | 19810462 | A1 | 9/1999 |
| DE | 10108511 | A1 | 2/2001 |
| DE | 19952796 | A1 | 6/2001 |
| DE | 10030341 | | 1/2002 |
| DE | 10059545 | A1 | 6/2002 |
| DE | 2004-002290 | | 8/2004 |

(Continued)

*Primary Examiner*—Ching Chang
(74) *Attorney, Agent, or Firm*—Quarles & Brady LLP

(57) ABSTRACT

A rocker arm includes a first end including a substantially horizontal wall having a receptacle formed therein. A second end of the rocker arm is spaced from the first end and includes a substantially horizontal wall for engaging a valve stem. A pair of spaced substantially parallel vertical sidewalls extend between the first end and the second end. In one embodiment, the sidewalls define a width between the first end and the second end that is less than each of the widths of the first and second ends. In another embodiment, a transverse wall extending between the sidewalls is formed in the second end. In yet another embodiment, rocker arm alignment walls are formed in the second end independently of the sidewalls.

21 Claims, 2 Drawing Sheets

FOREIGN PATENT DOCUMENTS

| | | | |
|---|---|---|---|
| EP | 1122408 | A1 | 8/2001 |
| EP | 1233150 | | 8/2002 |
| EP | 1357257 | | 10/2003 |
| EP | 1318278 | A2 | 11/2003 |
| EP | 1447526 | A1 | 8/2004 |
| EP | 1471214 | | 10/2004 |
| EP | 1609960 | B1 | 3/2007 |
| GB | 2222633 | A | 3/1990 |
| JP | 59-166757 | | 9/1984 |
| JP | 63-075305 | | 4/1988 |
| JP | 02-075707 | | 3/1990 |
| JP | 03-168306 | | 7/1991 |
| JP | 03-172506 | | 7/1991 |
| JP | 06-159018 | | 7/1994 |
| JP | 07-011919 | | 1/1995 |
| JP | 07-026913 | | 1/1995 |
| JP | 07-150910 | | 6/1995 |
| JP | 07-224613 | | 8/1995 |
| JP | 07-229407 | | 8/1995 |
| JP | 07-259512 | | 10/1995 |
| JP | 07-259513 | | 10/1995 |
| JP | 10-280915 | | 10/1998 |
| JP | 11-270311 | | 10/1999 |
| JP | 2000-054810 | | 2/2000 |
| JP | 2000-110522 | | 4/2000 |
| JP | 2000-120411 | | 4/2000 |
| JP | 2000-179309 | | 6/2000 |
| JP | 2001-047179 | | 2/2001 |
| JP | 2001-055913 | | 2/2001 |
| JP | 2001-129633 | | 5/2001 |
| JP | 2001-191139 | | 7/2001 |
| JP | 2001-289011 | | 10/2001 |
| JP | 2001-317311 | | 11/2001 |
| JP | 2002-276309 | | 9/2002 |
| JP | 2003-307104 | | 10/2003 |
| JP | 2003-328705 | | 11/2003 |
| JP | 2005-343215 | | 12/2003 |
| JP | 2004-027967 | | 1/2004 |
| JP | 2004-036486 | | 2/2004 |
| JP | 2004-100540 | | 4/2004 |
| JP | 2004-108375 | | 4/2004 |
| JP | 2004-156545 | | 6/2004 |
| JP | 2005-214092 | | 8/2005 |
| JP | 2005-264736 | | 9/2005 |
| JP | 2005-320976 | | 11/2005 |
| JP | 2006-291928 | | 10/2006 |
| WO | 03-031777 | A1 | 4/2003 |
| WO | 2006-112397 | A1 | 10/2006 |
| WO | 2007-023647 | A1 | 3/2007 |

* cited by examiner

ENGINE ROCKER ARM

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention generally relates to rocker arms, and more specifically to rocker arms used in internal combustion engines.

BACKGROUND OF THE INVENTION

A rocker arm controls opening and closing a valve in an internal combustion engine. A typical rocker arm includes a camming surface that engages a cam lobe of a cam shaft. Upon rotation of the cam shaft, the cam lobe urges one end of the rocker arm against a valve stem to open the valve. Upon further rotation of the cam shaft, a valve spring urges the valve closed.

The rocker arms are generally formed using methods known in the art, such as stamping, casting, and the like. The structure of the rocker arm must be sufficient to withstand the forces exerted by the cam lobe and valve stem and to withstand undesirable deformation during manufacture. Because the entire rocker arm reciprocates, however, the reciprocating mass of the rocker arm limits the engine's performance. Therefore, a need exists for a rocker arm having sufficient strength with a minimal mass.

SUMMARY OF THE INVENTION

The present invention provides a light weight rocker arm capable of withstanding the forces experienced under normal operating conditions of a typical internal combustion engine. The rocker arm includes a first end including a substantially horizontal wall having a receptacle formed therein. A second end of the rocker arm is spaced from the first end and includes a substantially horizontal wall for engaging a valve stem. A pair of spaced substantially parallel vertical sidewalls extend between the first end and the second end. In one embodiment, the sidewalls define a width between the first end and the second end that is less than each of the widths of the first and second ends. In another embodiment, a transverse wall extending between the sidewalls is formed in the second end. In yet another embodiment, rocker arm alignment walls are formed in the second end independently of the sidewalls.

A general objective of the present invention is to minimize the reciprocating mass of the rocker arm. In one embodiment, this objective is accomplished by providing a rocker arm having sidewalls defining a central portion width that is less than the widths of the rocker arm ends. In another embodiment, this objective is accomplished by stiffening a portion of the rocker arm with a transverse wall prior to a subsequent forming operation.

Another objective of the present invention is to minimize distortion of rocker arm engagement surfaces during manufacture. In one embodiment, this objective is accomplished by forming the rocker arm alignment walls independently of other features of the rocker arm. In another embodiment, this objective is accomplished by stiffening a portion of the rocker arm with a transverse wall prior to a subsequent forming operation.

These and other aspects of the invention are not intended to define the scope of the invention for which purpose claims are provided. In the following description, reference is made to the accompanying drawings, which form a part hereof, and in which there is shown by way of illustration, and not limitation, preferred embodiments of the invention. Such embodiments do not define the scope of the invention and reference must be made therefore to the claims for this purpose.

DETAILED DESCRIPTION

Figure 1:
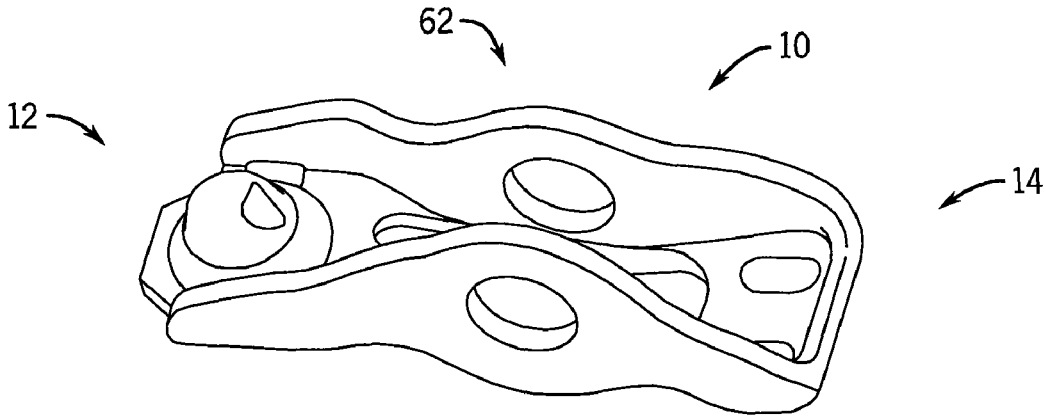
FIG. 1 is a perspective view of a rocker arm incorporating the present invention.
Figure 2:
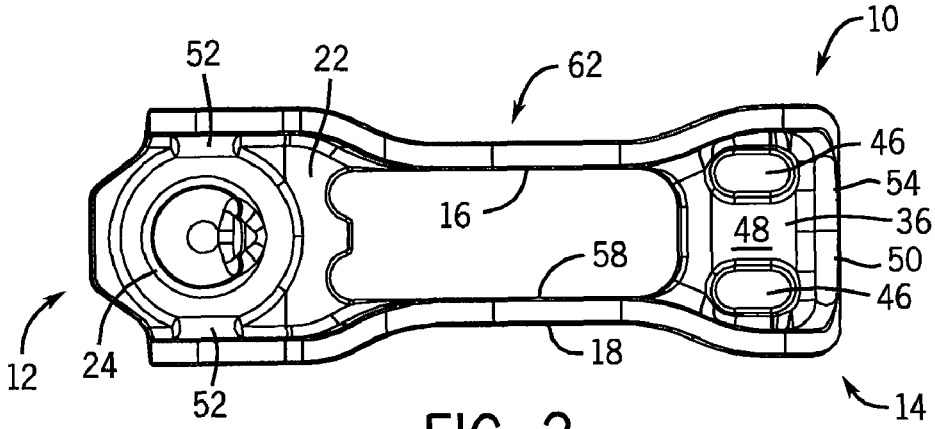
FIG. 2 is a top plan view of the rocker arm of FIG. 1.
Figure 3:
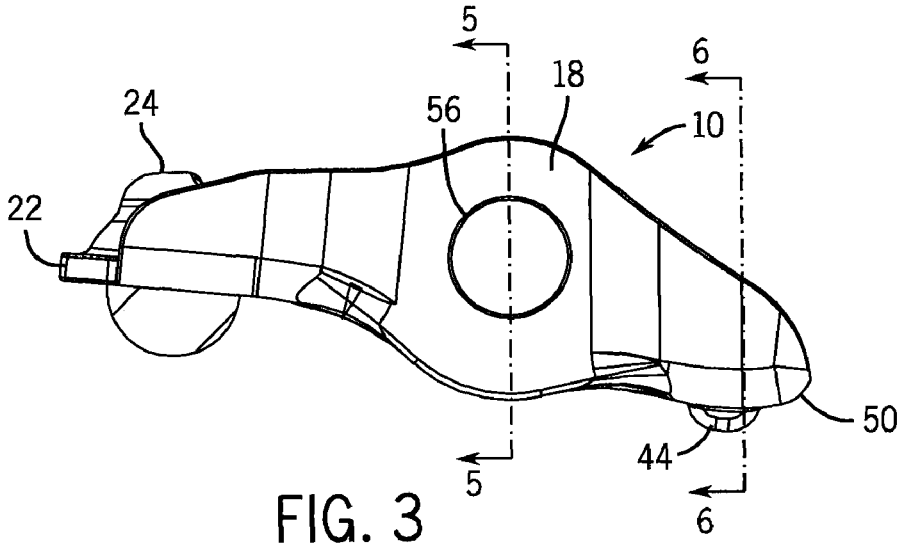
FIG. 3 is a side view of the rocker arm of FIG. 1.
Figure 4:
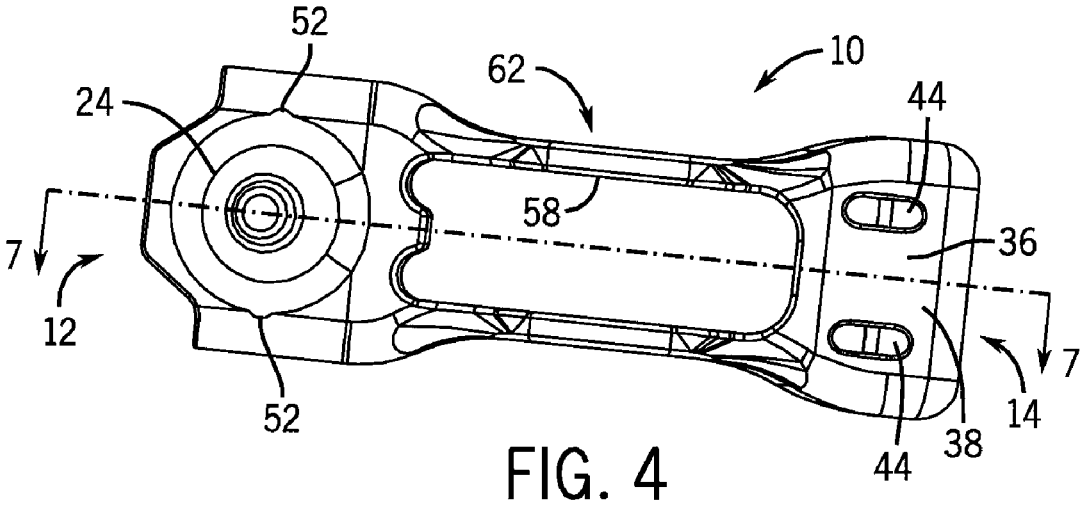
FIG. 4 is a bottom plan view of the rocker arm of FIG. 1.
Figure 5:
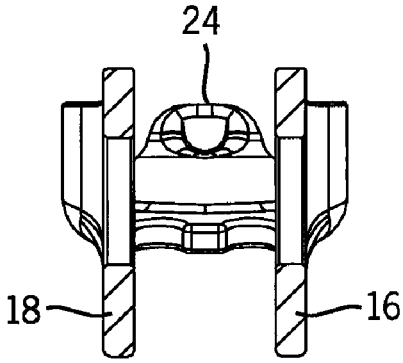
FIG. 5 is a cross sectional view 5-5 of the rocker arm of FIG. 3.
Figure 7:
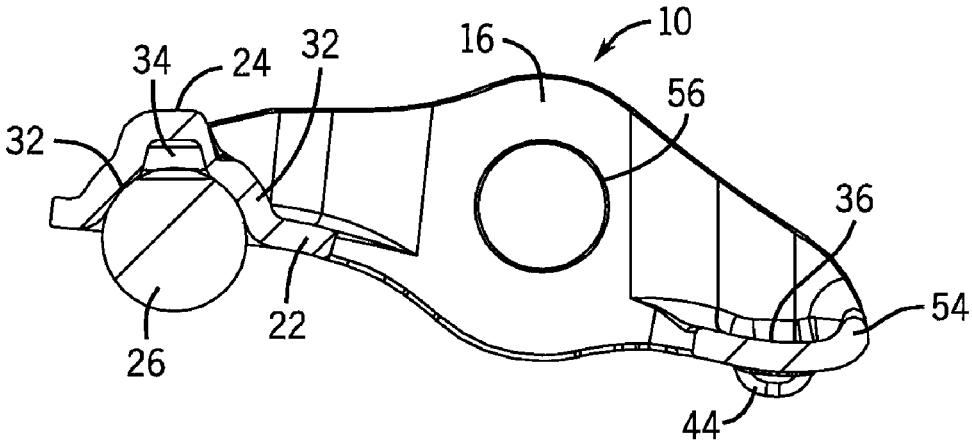
FIG. 7 is a cross sectional view 7-7 of the rocker arm of FIG. 4.

A rocker arm 10 incorporating the present invention is shown in FIG. 1, and includes a pivoting end 12 and valve engagement end 14 joined by sidewalls 16, 18. As shown in FIGS. 1-4, the first, or pivoting, end 12 includes a substantially horizontal wall 22 with a pivot receptacle 24 formed therein. A spherical end 26 of a lash adjuster (shown in FIG. 7) is received in the pivot receptacle 24 and the rocker arm 10 pivots about an axis extending through the lash adjuster spherical end 26. The semi-spherical pivot receptacle 24 is preferably stamped into a metal blank forming engagement surface 32 that engages the spherical end 26 of the lash adjuster. A lubricant receptacle 34 can also be provided at the top of the pivot receptacle 24.

Figure 6:
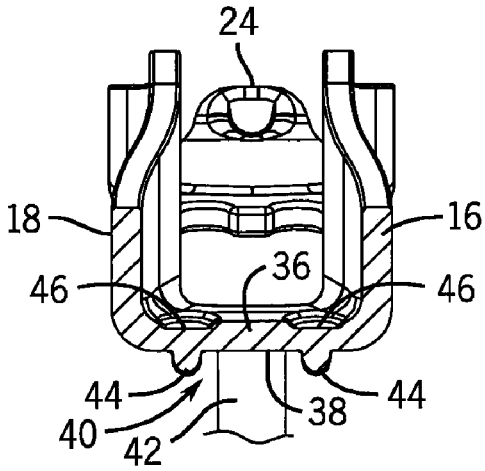
FIG. 6 is a cross sectional view 6-6 of the rocker arm of FIG. 3.

The second, or valve engagement, end 14 is spaced longitudinally from the pivoting end 12, and also includes a substantially horizontal wall 36. A bottom surface 38 of the horizontal wall 36 engages an end 40 of a valve stem 42 (shown in FIG. 6) to open a valve including the valve stem 42. The end 40 of the valve stem 42 is interposed between a pair of rocker arm alignment walls 44 which restrain lateral movement of the second end 14 on the valve stem end 40. The pair of spaced parallel rocker arm alignment walls 44 extend downwardly from the bottom surface 38 of the horizontal wall 36. In a preferred embodiment, the rocker arm alignment walls 44 are formed by stamping, or extruding, which also forms a pair of depressions 46 in a top surface 48 of the horizontal wall 36 above the rocker arm alignment walls 44. Of course, the rocker arm alignment walls 44 can be formed using other methods, such as piercing, without departing from the scope of the invention.

The first and second ends 12, 14 of the rocker arm 10 are joined by the substantially vertically extending sidewalls 16, 18 that extend from the distal end of the second end 14 to a point past a tangent point 52 of the pivot receptacle 24 of the first end 12. Preferably, the sidewalls are substantially perpendicular to the horizontal walls 22, 36 of the first and second ends 12, 14. A transverse wall 54 extending across the distal end 50 of the second end 14 stiffens the second end horizontal wall 36.

Advantageously, the entire rocker arm 10 can be formed using a thinner metal blank than the prior art without undesired distortions by forming features of the rocker arm in a specific order and/or independently of other features. Accordingly, in one embodiment, the vertically extending sidewalls 16, 18 and transverse wall 54 are formed by stamping the blank prior to forming the rocker arm alignment walls 44 to minimize undesirable deformation of the second end horizontal wall 36 while forming the rocker arm alignment walls 44. In another embodiment, the rocker arm alignment walls 44 are formed independently of the sidewalls 16, 18 and/or transverse wall to minimize distortion of the portion of the horizontal wall 36 between the rocker arm alignment walls 44.

As a result, a rocker arm that previously required a 3 mm thick metal blank can be formed using a metal blank having a thickness of 2.5 mm or less. Therefore, in a preferred embodiment, the metal blank has a thickness of less than 2.5 mm, and is preferably no more than 1.8 mm. Of course, a rocker arm formed from a metal blank having a thickness greater than 2.5 mm can be formed by stamping, or other methods, such as casting, and the like without departing from the scope of the invention.

Preferably, the rocker arm 10 is formed from a substantially flat blank which is stamped out of a metal sheet. In one embodiment, through holes 56 are formed in the sidewalls 16, 18, such as by stamping or punching, prior to folding edges of the blank to form the sidewalls 16, 18. Upon folding the sidewalls 16, 18 to the substantially vertical orientation, the through holes 56 are coaxially aligned for retaining a cylindrical cam surface (not shown), such as a roller having a roller axle received in the through holes 56. The cam surface extends through a cutout 58 defining an open space formed between the first and second ends 12, 14 and the sidewalls 16, 18 of the rocker arm 10. Preferably, the cylindrical cam surface has an axis of rotation coaxial with the coaxial through holes 56. Of course, the through holes 56 can be formed after forming the sidewalls without departing from the scope of the invention. Moreover, through holes can be omitted if the cam surface is an integral part of the rocker arm or the cam surface is retained using other methods, such as pockets receiving the roller axle of a roller.

The width of the first end 12 of the rocker arm 10 is defined between the vertically extending side walls 16, 18 and determined by the size requirements of the pivot receptacle 24. The width of the second end 14 is sized to accommodate the spacing of the rocker arm alignment walls 44 or the space required to fit a punch or stamp between the sidewalls 16, 18 when forming the rocker arm alignment walls 44, whichever is greater. The width of a central portion 62 defined between the first and second ends 12, 14 and the sidewalls 16, 18 is determined by the width of the cam surface which extends through the cutout 58. Preferably, the width of the cam surface is less than the widths of the first and second ends 12, 14 to minimize the width of the central portion 62, and thus the reciprocating mass of rocker arm 10. Of course, if a cam surface extending through a cutout is not required, the cutout 58 can be eliminated without departing from the scope of the invention or the cutout 58 can be provided to further minimize the reciprocating mass.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A rocker arm comprising:

a first end including a substantially horizontal wall having a receptacle formed therein, said first end defining a first width;

a second end spaced from said first end and including a substantially horizontal wall for engaging a valve stem, said second end defining a second width; and a pair of spaced substantially parallel vertical sidewalls extending between said first end and said second end, said pair of spaced substantially parallel vertical sidewalls defining a third width between said first end and said second end that is less than each of said first width and said second width.

2. The rocker arm as in claim 1, in which said sidewalls extend along said second end, and a substantially vertical transverse wall extends between said sidewalls.

3. The rocker arm as in claim 1, in which said sidewalls extend along only a portion of said first end.

4. The rocker arm as in claim 1, in which said second end includes a pair of spaced rocker arm alignment walls formed in said horizontal wall of said second end.

5. The rocker arm as in claim 4, including a depression formed in said horizontal wall of said second end above each of said rocker arm alignment walls.

6. The rocker arm as in claim 1, in which an open space is defined between said sidewalls at said third width.

7. The rocker arm as in claim 6, in which said horizontal walls are no more than 2.5 mm thick.

8. A method of forming a rocker arm, said method comprising:

forming a substantially flat rocker arm blank;

forming a receptacle in one end of said blank;

forming a pair of substantially vertical sidewalls in said blank, said sidewalls extending along a central portion between said one end and an opposing end; and forming rocker arm alignment walls in said opposing end independently of said sidewalls, wherein forming said rocker arm alignment walls includes forming depressions in a surface of said blank opposite from the surface of said blank from which said rocker arm alignment walls extend.

9. The method as in claim 8, including forming a transverse wall at a distal end of said opposing end, said transverse wall joining said sidewalls.

10. The method as in claim 9, in which said rocker arm alignment walls are formed only after forming said transverse wall.

11. A method of forming a rocker arm, said method comprising:

forming a substantially flat rocker arm blank;

forming a receptacle in one end of said blank;

forming a pair of substantially vertical sidewalls in said blank, said sidewalls extending along a central portion between said one end and an opposing end, wherein said sidewalls define a width at said central portion, a width at said one end, and a width at said opposing end, said width at said central portion being less than each of said width at said one end and said width at said opposing end; and forming rocker arm alignment walls in said opposing end independently of said sidewalls.

12. The method as in claim 8, including forming a cutout in said central portion of said blank between said one end and said opposing end.

13. The method as in claim 8, including forming through holes in said blank which are coaxially aligned upon forming said sidewalls.

14. The method as in claim 8, in which said sidewalls are formed prior to forming said rocker arm alignment walls.

15. The method as in claim 8, in which said rocker arm alignment walls are formed by one of stamping, extruding, and piercing.

16. A rocker arm comprising:

a first end including a substantially horizontal wall having a receptacle formed therein, said first end defining a first width;

a second end spaced from said first end and including a substantially horizontal wall for engaging a valve stem, said second end defining a second width;

a pair of spaced substantially parallel vertical sidewalls extending between said first end and said second end and along said second end, said sidewalls defining a third width between said first end and said second end;

a pair of spaced rocker arm alignment walls formed in said horizontal wall of said second end; and a depression formed in said horizontal wall of said second end above each of said rocker arm alignment walls.

17. The rocker arm as in claim 16, in which said sidewalls extend along only a portion of said first end.

18. The rocker arm as in claim 16, in which an open space is defined between said sidewalls at said third width.

19. The rocker arm as in claim 16, in which said horizontal walls are no more than 2.5 mm thick.

20. The rocker arm as in claim 16, in which said third width is less than said second width.

21. The rocker arm as in claim 16, including a substantially vertical transverse wall formed in said second end and extending between said sidewalls.

* * * * *